United States Patent [19]

Robbins, Jr.

[11] 4,340,633

[45] Jul. 20, 1982

[54] MAT ANCHORING APPARATUS AND METHOD

[76] Inventor: Edward S. Robbins, Jr., Florence, Ala.

[21] Appl. No.: 130,337

[22] Filed: Mar. 14, 1980

[51] Int. Cl.[3] ..... B32B 3/02; B32B 3/30

[52] U.S. Cl. ..... 428/99; 156/297; 428/40; 428/43; 428/189; 428/213; 428/906

[58] Field of Search ..... 428/40, 99, 343, 100, 428/906, 213, 189, 43; 156/297, 299; 16/1, 6; D6/209

[56] References Cited

U.S. PATENT DOCUMENTS

| | | | |
|---|---|---|---|
| 3,158,893 | 12/1964 | Smith | 16/4 |
| 3,585,101 | 6/1971 | Stratton et al. | 16/1 |
| 4,012,544 | 3/1977 | Richards | 428/100 |
| 4,097,628 | 6/1978 | Cheris | 428/906 |
| 4,165,555 | 8/1979 | Boxer et al. | 428/100 |

*Primary Examiner*—Paul J. Thibodeau

*Attorney, Agent, or Firm*—Cushman, Darby & Cushman

[57] ABSTRACT

A plastic web segment having a plurality of cleats on one side thereof and an adhesive coating on the other side thereof for attachment of the web segment to the underside of a mat to assist in retaining the mat in position on a carpet; as manufactured the web segment is provided with a removable paper shield over the adhesive coating and may be manufactured in the form of a roll of elongated length which is scored to facilitate separation of individual web segments therefrom.

4 Claims, 5 Drawing Figures

Fig. 3.
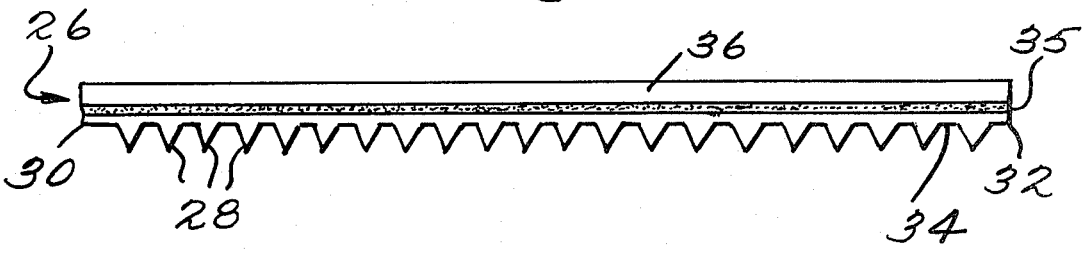
Fig. 4.
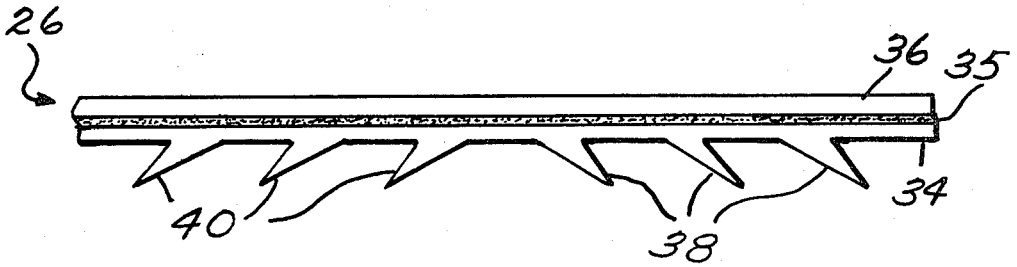
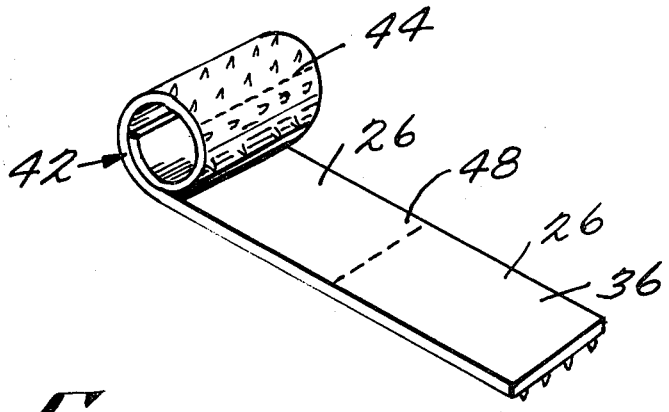
Fig. 5.

MAT ANCHORING APPARATUS AND METHOD

BACKGROUND AND BRIEF DESCRIPTION OF THE INVENTION

Protective mats as overlays for carpeting or expensive wood floors have long been is use for the purpose of preventing damage to the carpeting or permanent scarring of the surface of a wood floor. With the widespread commercial use of carpeting, however, smooth surfaced chair mats made of a plastic material have suffered from the disadvantage that such mats tend to slip out of position from under a desk or table. Where such mats are large in dimension, frequent repositioning of the mats can be very troublesome and time consuming particularly where the rearrangement or moving of furniture is required.

In the prior art, in order to lessen this disadvantage, some manufacturers have constructed the mats with a pattern of cleats on one side thereof so that when the mats are placed face down on a carpeted surface, the mats will remain in position. Another attempted solution has involved the use of grooved devices which are attached along the side of the mats and which are provided on an underside with cleats for engaging carpet. However, these latter devices have not proved staisfactory since the smooth surfaced carpets slide out of the grooves rather easily after only a short period of time. In addition, it has been found that the conventional chair mat which is formed with integral cleats on one surface thereof has not been useful on all types of carpets since the degree of retaining power of the cleats varies as the depth and cut of the carpet pile varies. Thus, a standard cleat height and pattern for a chair mat, for example, will only be useful for a limited range of carpet types.

In many offices, attempts to retain a smooth surface chair mat in place can result in cracking of the plastic material of the mats such as when furniture is placed on top of a portion of the mat or when the mat is squeezed between movable pieces of furniture. Similarly, where anchoring pins have been inserted through the mats to hold them in place the underlying carpet eventually can be torn thus defeating the primary reason for utilizing the protective mat itself.

The present invention overcomes the foregoing difficulties by providing a web or strip of plastic material which on one face is provided with a plurality of projecting cleats and on the opposite surface with a pressure sensitive adhesive to enable the web segment or strip to be attached to the smooth undersurface of a mat. In addition, the present invention provides a unique package for the strips where a shield is placed over the adhesively coated surface and the strips are formed by placing perforations in a roll of plastic material to facilitate separation of individual web segments, as needed. A manufacturer can, therefore, construct a roll with web segments having differing cleat patterns and dimensions so that a single roll or a plurality of rolls can be sold to a customer who can then select the appropriate web segment to hold a chair mat on a particular type of carpet that has already been installed on a floor surface.

The foregoing and other advantages will become apparent as consideration is given to the following detailed description taken in conjunction with the accompanying drawings, in which:

BRIEF DESCRIPTION OF THE DRAWINGS

FIG. 3 is an end view of one embodiment of the web segments of the present invention;

FIG. 4 is an end view of another embodiment of the web segments of the present invention; and FIG. 5 is a perspective view showing a package of the web segments of the present invention.

DETAILED DESCRIPTION OF THE INVENTION

Figure 1:
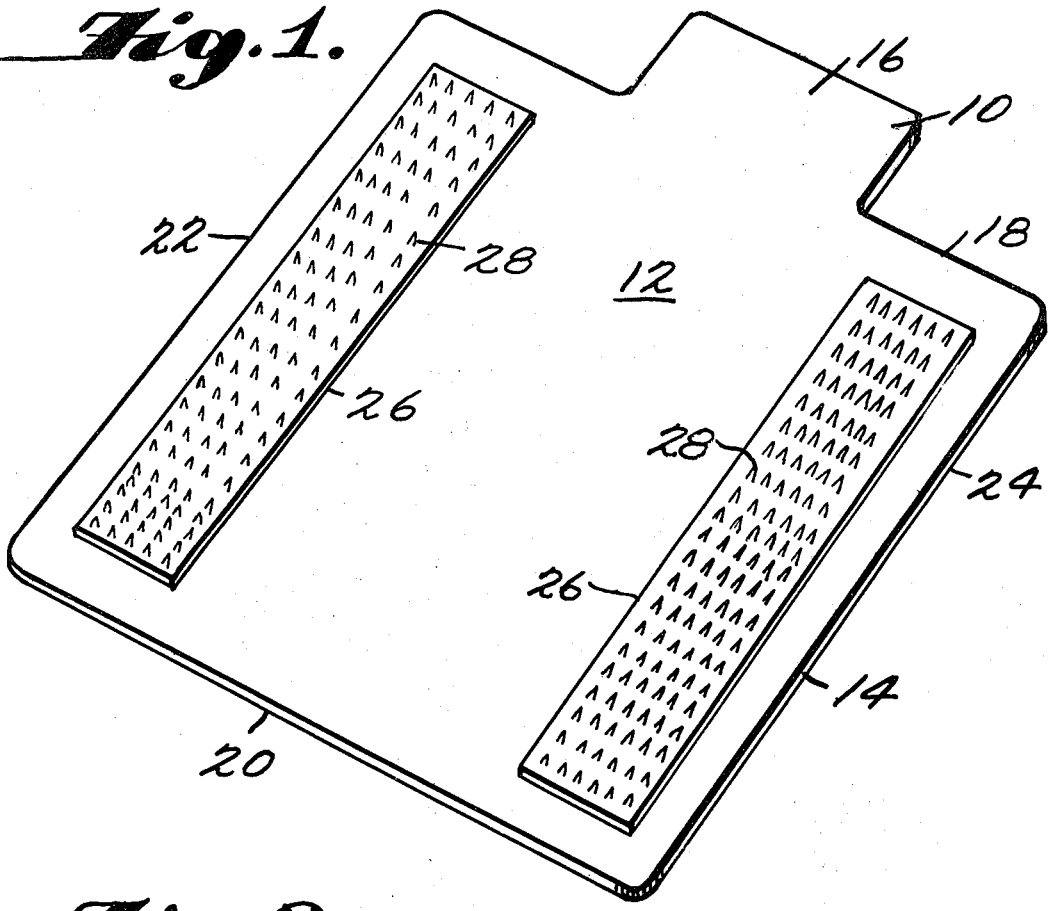
FIG. 1 is a perspective view of the underside of a chair mat showing two web segments of the present invention installed thereon.

Referring to the drawings wherein like numerals designate corresponding parts throughout the several views, there is shown in FIG. 1 a chair mat 10 of conventional construction having a smooth bottom surface 12 and a top surface 14 which may be smooth or patterned, as desired. Such mats are made from a variety of plastic materials such as lucite or vinyl and are presently manufactured in a variety of shapes to accommodate different office layouts. For this reason, it is undesirable to replace on a large scale such mats where they have been manufactured or cut to specific sizes and shapes. As illustrated in FIG. 1, the chair mat 10 has a lip 16 for fitting into the chair well of a desk and substantially parallel front and rear edges 18 and 20, respectively. The substantially parallel side edges 22 and 24 may be of any desired length depending on the office layout.

According to the present invention, web segments or strips 26 are adhesively attached to the bottom surface 12 of the mat 10 so that when the surface 12 is placed on top of a carpet the cleats 28 which project from one surface of the segments 26 will grip the carpet and hold the mat 10 in a desired position.

To this end, as shown in FIG. 1, the web segments 26 may be attached to extend from adjacent the front edge 18 to adjacent the rear edge 20 along the side edges 22 and 24 of the mat 10.

Figure 2:
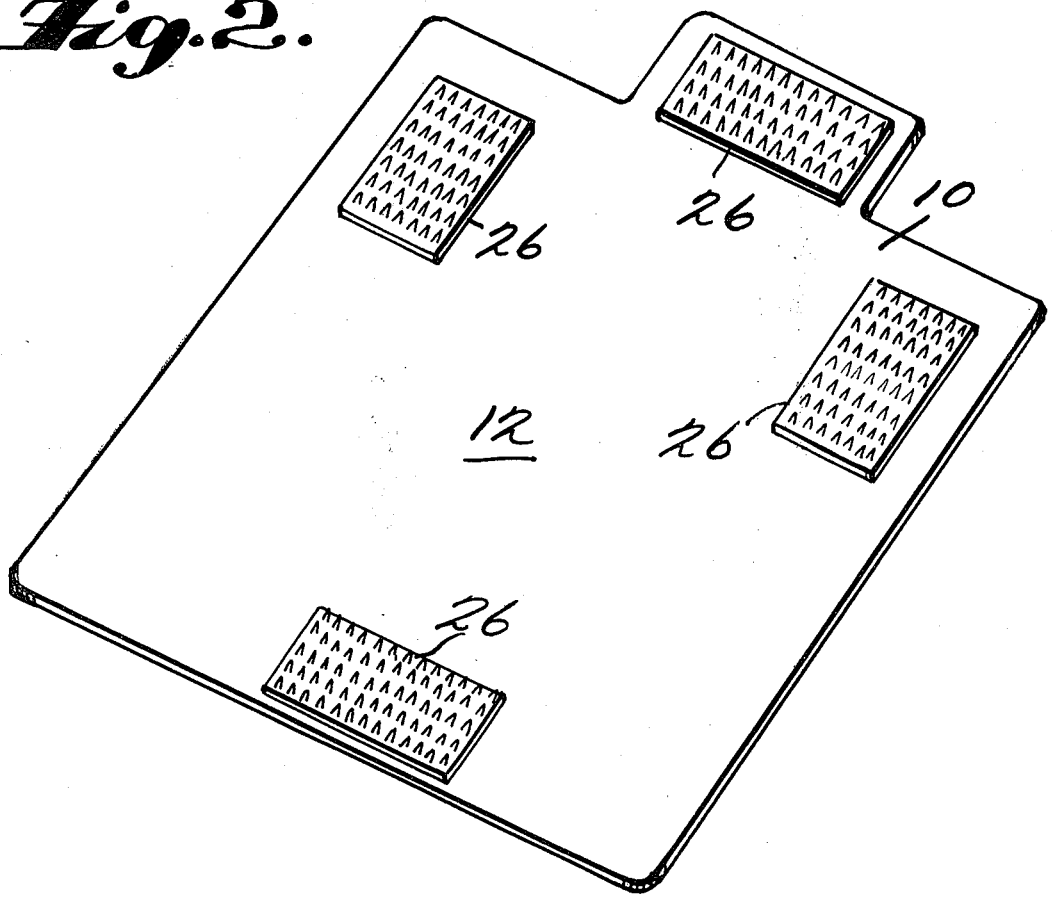
FIG. 2 is a view similar to FIG. 1 where a different array of web segments of the present invention are illustrated.

As shown in FIG. 2, a different array of the web segments 26 is shown and which may be used to take into account differences in the grain of a carpet or the different repeated motions of the person sitting on a chair resting on the mat.

In FIG. 3 there is shown an end view of one of the strips or web segments 26 prior to attachment to the surface 12 of a mat 10. In particular, the web segment 26 includes a section of plastic material 30 which has an upper flat surface 32 and an oppositely facing surface 34 from which project the cleats 28. The height of the cleats 28 should be at least twice the thickness of the web segment as measured between the surfaces 32 and 34 to facilitate flexing of the segments such as during attachment to the undersurface of a mat whereby the formation of air bubbles can be avoided. An adhesive coating 35 is applied to the surface 32 of the web segment 30 and a protective shield such as a sheet of paper 36 is applied to the adhesive coated portion. There are a variety of pressure sensitive or other types of adhesives available commercially for this type of application.

As shown in FIG. 3, the cleats 28 are conical in shape and extend generally perpendicularly to the surface 34. However, as shown in FIG. 4, some or all of the cleats may be formed to extend at an angle to the surface 34 such as at 38. In some applications all of the cleats 38 formed to extend from surface 34 may be inclined in a single direction across the entire surface or, as shown in FIG. 4, only a portion of the cleats may be formed to extend in one direction while other numbers of the cleats such as at 40 may extend in an opposite direction to improve the retaining power of the web segment 26. With such an arrangement, the web segments 26 may be disposed on the underside of a chair mat in positions to provide the best retention power for the particular fiber grain of the underlying carpet.

As shown in FIG. 5, a useful package for the web segments of the present invention is provided by forming the desired cleat pattern on one side of a roll 42 which, in turn, is provided with severing lines in the form of perforations 44 to facilitate separation of the roll into the individual web segments 26. Similarly, the shield means 36 is perforated along corresponding lines 48. The width of the roll may be four inches while the length of the segments 26 may be six to twelve inches between the score lines or perforations 44. It will be understood, of course, that the length and width of the individual segments 26 can be varied and that the illustrated embodiment is by way of example only.

If desired, the adhesive coating 35 need not cover the entire surface 32 of a web segment 26 but may, instead, cover only a portion thereof. For example, the adhesive 35 may be deposited in a plurality of spaced locations on the surface 32. The thickness of the web segments 26 should be approximately $\frac{1}{8}$ of an inch to facilitate rolling of the roll 42 into a package that is convenient to handle and store. The roll of course is substantially greater than its width and may be of any desired length.

Having described the invention, it will be apparent to those skilled in this art that various modifications may be made therein without departing from the spirit and scope of the present invention as defined in the appended claims.

What is claimed is:

1. A substantially rigid chair mat having a smooth surface on one side thereof, at least two web segments each of which has a surface area that is substantially less than the surface area of said smooth surface of said chair mat and each of said web segments having one face thereof adhesively secured to a portion of said one side of said chair mat and another face having a plurality of substantially rigid cleat means projecting from said respective web segment with a selected number of said cleat means projecting in a given angular direction from the other face of said respective web segment while others of said cleat means project in a different angular direction relative to said given angular direction whereby when said chair mat is placed on a carpet surface, said cleat means will restrain movement of said chair mat on the carpet surface.

2. The web segment of claim 1 wherein said web segment and cleat means are integrally formed from vinyl.

3. The web segment of claim 1 wherein said cleat means are conically shaped.

4. The web segment as claimed in claims 1 or 2 wherein the height of said cleat means is at least twice the thickness of said web segment.

* * * * *